United States Patent [19]

Galper

[11] Patent Number: 5,033,350

[45] Date of Patent: Jul. 23, 1991

[54] SINGLE REED MOUTHPIECE

[76] Inventor: Avrahm Galper, 679 Coldstream Ave., Toronto, Ontario, Canada, M6B 2L6

[21] Appl. No.: 489,214

[22] Filed: Mar. 6, 1990

[51] Int. Cl.[5] ..... G10D 9/02

[52] U.S. Cl. ..... 84/383 R

[58] Field of Search ..... 84/383 R, 383 A, 383 B, 84/380 A

[56] References Cited

U.S. PATENT DOCUMENTS

| | | | |
|---|---|---|---|
| 867,832 | 10/1907 | Nelson | 84/380 A |
| 1,376,213 | 4/1921 | Mazzeri | 84/383 R |
| 1,401,634 | 12/1921 | O'Brien | 84/383 R |
| 2,467,921 | 4/1949 | Werner | 84/383 R |
| 2,495,484 | 1/1950 | Schemenauer | 84/383 R |
| 2,988,947 | 6/1961 | Houser | 84/383 R |
| 4,517,875 | 5/1985 | Dossekker | 84/383 R |

*Primary Examiner*—Brian W. Brown

*Attorney, Agent, or Firm*—Sim & McBurney

[57] ABSTRACT

An improvement in single and double reed mouthpieces for musical instruments comprising a pair of rounded or flat elongate protrusions along portions of the lay surfaces of the mouthpiece body on opposite sides of the vibrating portion of the reed, for reducing a player's lip pressure on the vibrating portion of the reed.

6 Claims, 3 Drawing Sheets

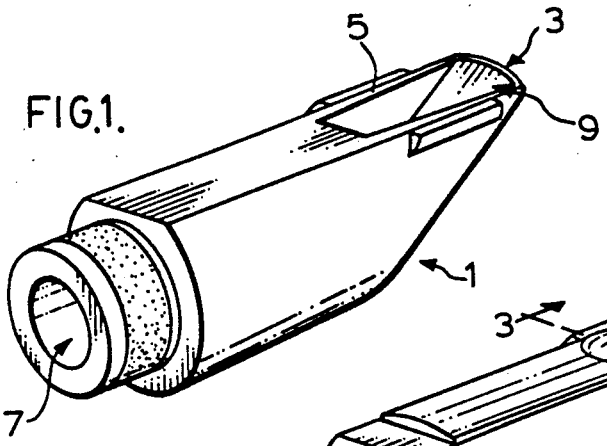
FIG.1.
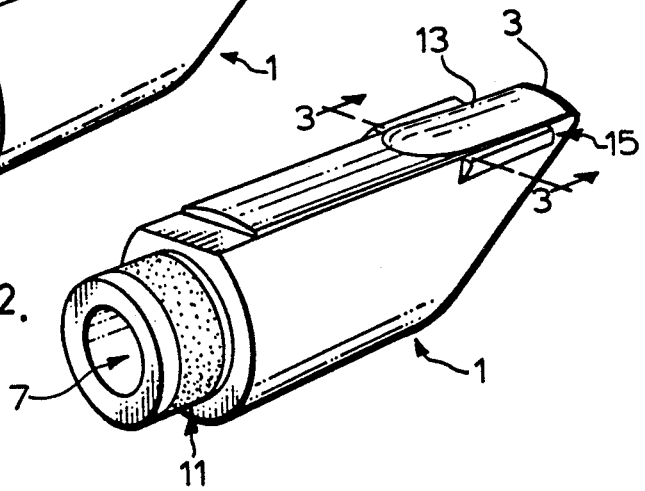
FIG.2.
FIG.3A.
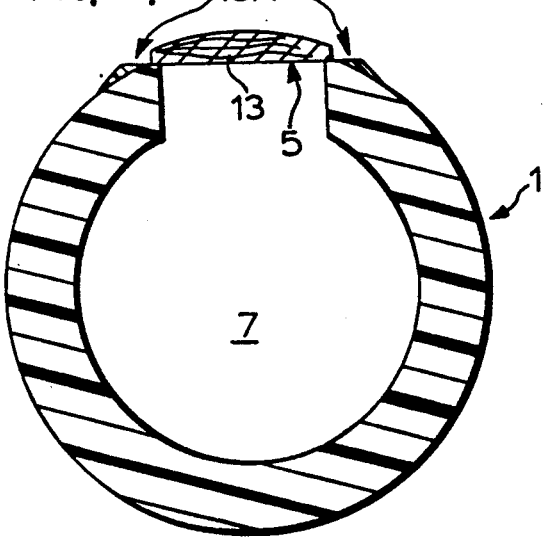
FIG.3B.
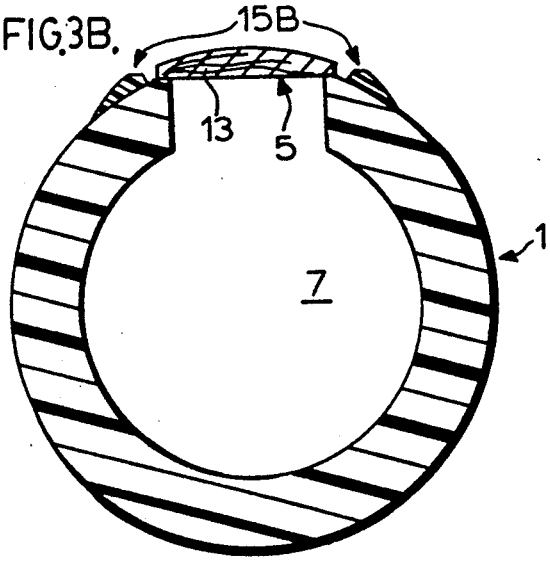
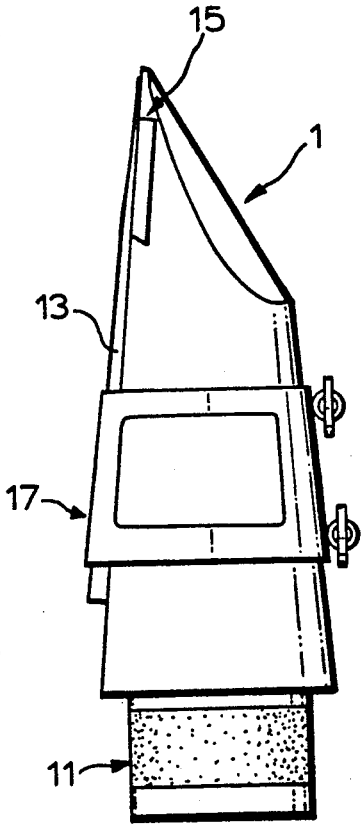
FIG.4.

SINGLE REED MOUTHPIECE

FIELD OF THE INVENTION

This invention relates in general to an improvement for single reed mouthpieces for use in wind instruments such as the family of clarinets, (soprano, alto, bass etc.,) the family of saxophones (soprano, alto, tenor etc.) and the Tarogatto. More particularly, the invention relates to an improvement by which a player's lip pressure on the vibrating portion of the reed is reduced.

BACKGROUND OF THE INVENTION

According to well known prior art, the curved outside wall portions of single reed mouthpieces slope downward immediately on either side of the lay surface, on both sides of the reed. It has been found that when playing the mouthpiece, this immediate downward sloping often allows and causes the sides of a player's lips (embouchure) to exert undue pressure on the reed and stifle its vibrations.

U.S. Pat. No. 2,988,947 (Houser) discloses one approach to solving this problem. In particular, the Houser patent teaches an attachment member which surrounds the end of the mouthpiece, including the reed. By completely enveloping the reed, the attachment member permits the lip of the player to depress the lower surface of the reed while, at the same time, preventing undue pressure from being exerted against it.

The device of Houser suffers from the disadvantage of requiring a modified mouthpiece and an expensive, complex connection of the attachment member thereto. The attachment member and mouthpiece of Houser are cumbersome and bulky, and would not provide a player with the "feel" of a standard mouthpiece.

SUMMARY OF THE INVENTION

According to the present invention, a pair of rounded or flat elongate protrusions are provided along the side part of the lay surface on opposite sides of the vibrating portion of the reed for reducing the player's lip pressure on the vibrating portion of the reed. The protrusions can be incorporated into the mouthpiece itself or can take the form of simple adhesive material adapted to stick directly onto the sloping surface, for retrofit modification of a standard mouthpiece, or may assume the form of extensions or fingers on a modified ligature. In addition, the protrusions may be in the form of extensions from a modified U-shaped reed holder adapted to be secured to the mouthpiece by the ligature, as discussed in greater detail below.

Some of the advantages flowing from the present invention are as follows: the instrument sound is more resonant, the player is able to achieve better slurs to and from the third register, the reed lifetime is extended, softer reeds feel harder than they actually are, and stifling of the reed vibrations is substantially reduced.

The above advantages of the present invention are obtained without the requirement for cumbersome and expensive attachments and modified mouthpieces, as in the known prior art.

According to a general aspect of the present invention, there is provided in a single reed mouthpiece for musical instrument comprising a body with a bevelled planed lay surface over which a reed is adapted to vibrate, and a bore hole extending from one end of said body to a window disposed centrally of said lay surface, the improvement comprising a pair of elongate protrusions extending outward on said mouthpiece on opposite sides of the vibrating portion of said reed for reducing a player's lip pressure on said vibrating portion of the reed.

BRIEF DESCRIPTION OF THE DRAWINGS

FIG. 1 is a perspective view of a well known prior art mouthpiece without reed;

FIG. 2 is a perspective view of a mouthpiece and reed, incorporating the improvement in accordance with a preferred embodiment of the invention;

FIGS. 3A and 3B are cross sectional view of alternative embodiments of the invention, along the lines 3—3 in FIG. 2;

FIG. 4 is a side view of a mouthpiece with ligature incorporating the improvement of the present invention in accordance with the preferred embodiment;

DETAILED DESCRIPTION OF THE INVENTION

Figure 5:
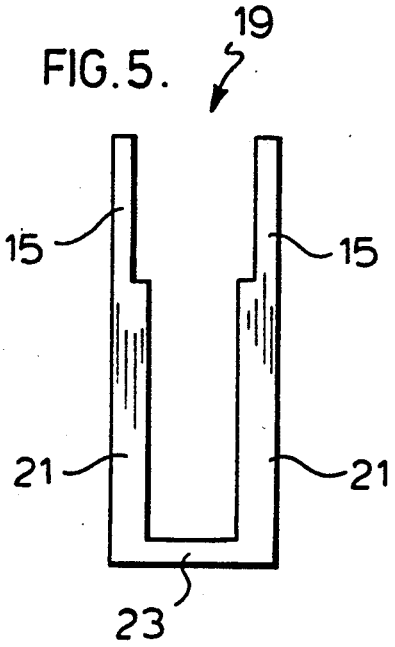
FIG. 5 is a plan view of a reed holder without reed incorporating the improvement of the present invention according to a first alternative embodiment.

Turning briefly to FIG. 1, a well known prior art mouthpiece 1 is shown formed of a manufactured body tapering to an edge 3. A top portion of the body is bevelled to form a planed lay surface 5 on which the reed (not shown) is adapted to vibrate. A generally cylindrical and conical bore hole 7 extends from a rear end of the cylindrical body and terminates at an aperture or window 9 in the lay surface, in a well known manner.

With reference to FIGS. 2, 3A and 3B, the standard mouthpiece of FIG. 1 is shown with a reed 13 positioned to vibrate on the planed lay surface 5. In addition, in accordance with the present invention there is provided a pair rounded or flat elongate protrusions 15 projecting from the sides of the mouthpiece 1 on both sides of the vibrating portion of the reed 13.

The embodiment of FIG. 3A depicts the elongate protrusions 15A as being flat and coplanar with the surface 9. The embodiment of FIG. 3B illustrates the protrusions 15B as being rounded and forming a continuation of the radius of curvature of the top surface of the vibrating portion of the reed 13.

As discussed above, in standard mouthpieces the sides of a player's lips bear down on the side edges of the vibrating portion of the reed, thereby exerting undue pressure and stifling vibrations of the reed. In accordance with the invention as shown in FIG. 3A, the lay surfaces 5 of the mouthpiece 1 are effectively extended. Alternatively, in the embodiment of FIG. 3B, the sloping sides of the mouthpiece are elevated via protrusions 15B on opposite sides of vibrating portion of the reed 13 to a level or height up to or equal to the top surface of the vibrating portion of the reed. In this way, the player's lips are prevented from exerting undue pressure on the reed, resulting in a more resonant sound, better slurs to and from the third register, extended reed lifetime and a harder feel to softer reeds.

FIG. 4 illustrates one side of the mouthpiece 1 showing the extent of the protrusions 15, and the reed 13 secured via a ligature 17, in a well known manner.

Figure 6:
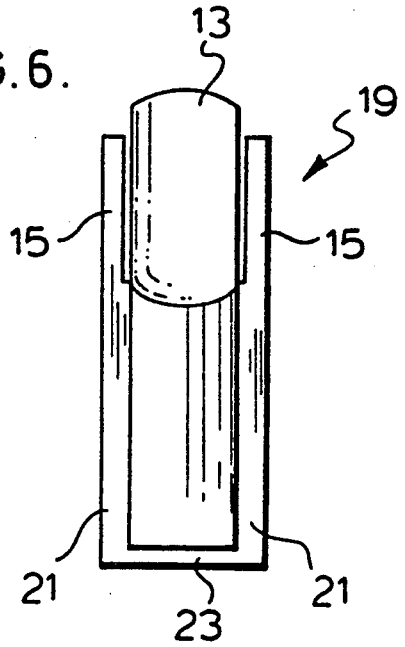
FIG. 6 is a plan view of the reed holder of FIG. 5 in combination with a reed.

According to a first alternative embodiment illustrated in FIGS. 5 and 6, a U-shaped reed holder 19 is adapted to be secured to a mouthpiece via a ligature (not shown). The reed holder 19 comprises a pair of arms 21 extending in parallel from a transverse member 23. The arms 21 include a stepped portion on respective inner surfaces thereof such that the portion of the arms 21 proximate transverse member 23 underlie and support the reed 13 while protrusions 15 extend from the arms 21 in the form of fingers and are disposed on opposite sides of the vibrating portion reed of 13. The protrusions 15 function in a manner similar to the preferred embodiment of FIGS. 2, 3A, 3B and 4 to effectively extend or elevate a portion of the lay surface to a level or height up to or equal to the top of the vibrating portion of reed 13, for preventing a player's lips from exerting undue pressure on the reed.

Figure 7:
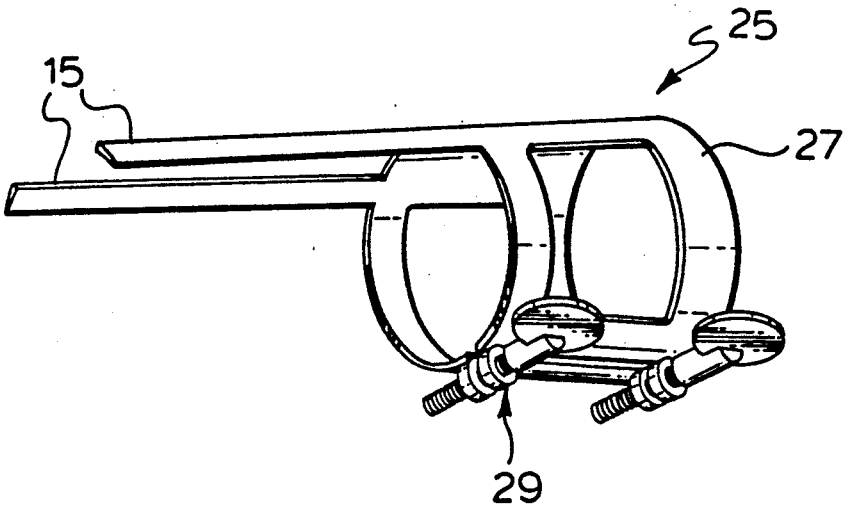
FIG. 7 is a perspective view of a modified ligature incorporating the improvement of the present invention in accordance with a second alternative embodiment.

A second alternative embodiment is shown with reference to FIG. 7, in the form of a modified ligature 25. The ligature 25 comprises a generally conical band 27 adapted to fit around a mouthpiece (not shown) for securing a reed thereto. A pair of protrusions 15 extend from the conical band 27 and are adapted to be disposed on opposite sides of a reed (not shown). The band 27 may be tightened or loosened around the stock of a mouthpiece (as shown in FIG. 4) by means of the screw 29, in a well known manner. The protrusions 15 on modified ligature 25 operate in an identical manner to the protrusions 15 in the embodiments of FIGS. 2–4, and the embodiments of FIGS. 5 and 6.

A third alternative embodiment is illustrated with reference to FIG. 8, for use with double reed instruments (e.g. oboe, bassoon, etc.), the improvement comprising a pair of elongate protrusions 15 parallel to the length of a double reed 17 and extending almost to the tip thereof. The protrusions are inserted into cooperatively sized apertures 19 (FIG. 9) in a collar 21 adapted to fit around the corked portion 23 of the reed 17.

The protrusions 15 may be made of constant or varying thickness to accommodate any desired reduction of the lip pressure on the reed 17.

On a bassoon double reed, the collar 21 would be adapted to fit on a portion of the reed below the wound portion thereof.

Figure 8:
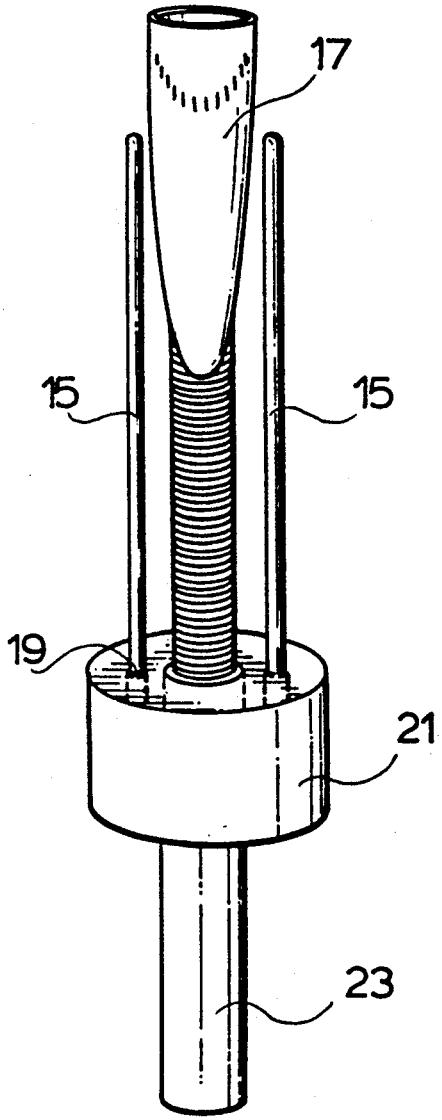
FIG. 8 is a perspective view of a modified reed holder for double reed instruments in accordance with a further alternative embodiment.
Figure 9:
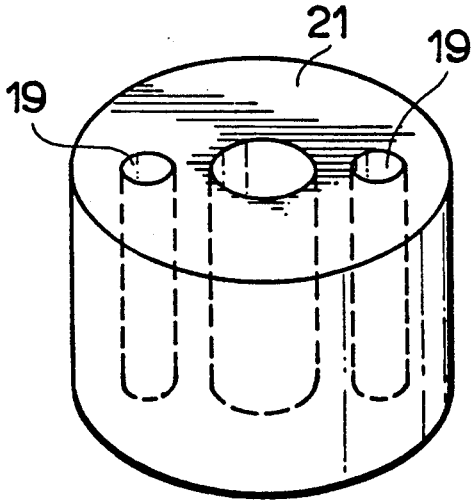
FIG. 9 is a perspective view of a collar for the modified reed holder of FIG. 8.

In accordance with the embodiment of FIGS. 8 and 9, the lip pressure of a double reed instrument player on the reed itself is substantially reduced than when using a conventional reed and holder without the protrusions 15. As a result of reduced lip pressure, the instrument sound has been found to be more resonant, the reed lifetime is extended, soft reeds are made to feel harder than they actually are, and stifling of the reed's vibration is substantially reduced. Furthermore, it has been found easier to manipulate the sound in portions of the instrument that require gentle lip pressure.

A person understanding the present invention may conceive of other embodiments or variations therein. All such embodiments or variations are believed to be within the sphere and scope of the present invention as defined by the claims appended hereto.

I claim:

1. A reed holder adapted to be secured via a ligature to a reed instrument mouthpiece, comprising a generally U-shaped element having a pair of arms extending in parallel from a transverse member, opposite inner sides of said pair of arms being stepped inwardly for supporting said reed proximate said member, said arms extending along opposite sides of said reed forming a pair of protrusions for preventing a player's lips from exerting undue pressure on said reed.

2. A ligature for use with a single reed musical instrument mouthpiece, comprising a generally cylindrical band adapted to fit around said mouthpiece for securing a reed thereto, and a pair of protrusions extending from said band on opposite sides of said reed for preventing a player's lips from exerting undue pressure on the vibrating portion of said reed.

3. In a double reed for musical instruments, the improvement comprising a collar adapted to fit around said reed, and a pair of protrusions projecting from said collar parallel to said reed and on opposite sides thereof and extending approximately to a distal end of said reed and adapted to be inserted into a player's mouth for preventing said player's lips from exerting undue pressure in the vibrating portion of said reed.

4. In a single reed mouthpiece for musical instruments, said mouthpiece comprising a body with a bevelled planed lay surface over which a reed is adapted to vibrate, and a bore hole extending from one end of said body to a window disposed centrally of said lay surface, the improvement comprising a pair of elongate protrusions extending outward from said mouthpiece on opposite sides of the vibrating portion of said reed for preventing a player's lips from exerting undue pressure on said vibrating portion of said reed, wherein each said pair of elongate protrusions is characterized by a flat top surface extending outwardly coplanar with said lay surface.

5. In a single reed mouthpiece for musical instruments, said mouthpiece comprising a body with a bevelled planed lay surface over which a reed is adapted to vibrate, and a bore hole extending from one end of said body to a window disposed centrally of said lay surface, the improvement comprising a pair of elongate protrusions extending outward from said mouthpiece on opposite sides of the vibrating portion of said reed for preventing a palyer's lips from exerting undue pressure on said vibrating portion of said reed, wherein each said pair of elongate protrusions is characterized by a rounded top surface extending up to the height of said vibrating portion of the reed.

6. In a single reed mouthpiece for musical instruments, said mouthpiece comprising a body with a bevelled planed lay surface over which a reed is adapted to vibrate, and a bore hole extending from one end of said body to a window disposed centrally of said lay surface, the improvement comprising a pair of elongated protrusions extending outward from said mouthpiece on opposite sides of the vibrating portion of said reed for preventing a player's lips from exerting undue pressure on said vibrating portion of said reed, wherein each said pair of elongate protrusions is formed from adhesive material adapted to stick on respective side surfaces of said body adjacent said lay surface.

* * * * *